US005560279A

United States Patent [19]

Connors et al.

[11] Patent Number: 5,560,279

[45] Date of Patent: Oct. 1, 1996

[54] PRE-FAILURE SENSING DIAPHRAGM

[75] Inventors: William T. Connors, Newark; William E. Delaney, III, Hockessin, both of Del.; Kevin J. Kirk, Elkton, Md.

[73] Assignee: W. L. Gore & Associates, Inc., Newark, Del.

[21] Appl. No.: 406,220

[22] Filed: Mar. 16, 1995

[51] Int. Cl.[6] ..... F01B 25/26

[52] U.S. Cl. ..... 92/5 R; 92/103 SD; 417/63

[58] Field of Search ..... 92/5 R, 96, 98 R, 92/103 R, 103 SD; 417/63

[56] References Cited

U.S. PATENT DOCUMENTS

| | | | |
|---|---|---|---|
| 4,569,634 | 2/1986 | Mantell | 92/5 R |
| 4,740,139 | 4/1988 | Mantell | 92/5 R |
| 4,787,825 | 11/1988 | Mantell | 92/5 R |
| 4,934,902 | 6/1990 | Mantell | 92/5 R |
| 4,971,523 | 11/1990 | Wacker et al. | 92/5 R |
| 5,062,770 | 11/1991 | Story et al. . | |
| 5,217,797 | 6/1993 | Knox et al. | 91/103 SD |
| 5,374,473 | 12/1994 | Knox et al. | 428/218 |

FOREIGN PATENT DOCUMENTS 1453454 2/1969 Germany .

*Primary Examiner*—F. Daniel Lopez
*Attorney, Agent, or Firm*—Victor M. Genco, Jr.

[57] ABSTRACT

A combined sensing and barrier element is provided. This sensing element is most useful as a flexible diaphragm which is also described herein. The flexible diaphragm has a resilient elastomeric body and a sensing element having at least one conductive component and at least two nonconductive components such that the conductive component is positioned between the nonconductive components. A change in electrical resistance is recorded by an electrical monitoring device that is electrically connected to the conductive component. By observing changes in the resistance that deviate from a predetermined norm, significant wear of a diaphragm can be determined prior to its failure.

19 Claims, 7 Drawing Sheets

PRE-FAILURE SENSING DIAPHRAGM

FIELD OF THE INVENTION

A diaphragm is provided that has a pre-failure sensing mechanism which is particularly useful in pump applications when a flexible barrier to chemicals is necessary.

BACKGROUND OF THE INVENTION

Pumps, such as those used in the chemical, petrochemical, or pharmaceutical industries, employ diaphragms to separate the fluid being pumped from the fluid which initiates diaphragm actuation. Typically, these diaphragms are made of rubber, and undergo extensive repetitive flexing while in use. In many instances, the fluid being pumped is of a corrosive nature which often causes a diaphragm to fail rapidly. Failure of the diaphragm may result in corrosive liquid contaminating equipment. A diaphragm failure may also cause the release of chemicals to an air stream that subsequently gets released into the environment where it may result in further damage or injury.

To protect against such failure, many attempts have been made to extend the lives of such diaphragms. Often, chemically resistant materials such as polytetrafluoroethylene (PTFE) are used as an overlay to a rubber diaphragm so that the rubber is protected from the corrosive chemicals. This type of construction also has utility in protecting high purity fluids from contamination due to rubber degradation. In other instances, a chemically resistant material is used as the sole material of construction of the diaphragm. However, when PTFE is used as the sole material, or when used as an overlay, the PTFE fatigues more readily from flexing as compared to conventional rubbers.

Failure of a diaphragm is normally preceded by the development of minute cracks, tears, and other discontinuities that propagate until there is a complete failure, at which time there is an unwanted passage of liquid between pump chambers. Attempts have now been made to predict beforehand the oncoming failure of a diaphragm. Such attempts include use of an electrically conductive material extending within a nonconductive, chemically inert diaphragm, as described in U.S. Pat. No. 4,569,634. The electrically conductive material is in the form of a mesh screen, or web of conductive fibers and is designed to be spaced equally from both faces of the diaphragm. The use of such screens, meshes, or fibers within a nonconductive, chemically inert material, such as PTFE, causes abrasions within the nonconductive material, particularly when undergoing extensive flexing, which shortens the useful life of the diaphragm.

Copending U.S. Pat. application Ser. No. 08/110,684 provides for a prefailure warning pump diaphragm in which a barrier sheet of PTFE has embedded within it a thin flexible conductive fiber made of conductive PTFE. Before the onset of failure, the conductive fiber detects the change in conductivity by suitable electronic means which signals imminent failure. However, change in fiber resistivity is very difficult to detect. Also, only a finite area of the face of the diaphragm is covered by the fiber, thus creating a possibility for an undetected failure.

Other commercially available products include a Wil-Gard™ I Diaphragm Monitoring System made by Wilden Pump and Engineering Co., of Colton, Calif. This device provides for a resistivity sensor located between a PTFE overlay and a backup elastomeric material. This device also only detects leakage after the diaphragm has failed. Moreover, additional and substantial damage may occur if corrosive chemicals cause deleterious effects to the elastomeric backup material.

Finally, other types of leak detection devices for pumps have been developed. U.S. Pat. No. 5,062,770 to Story, et al. provides for a containment chamber in a pump after the PTFE diaphragm has failed. Unfortunately, such devices do not detect pre-failure conditions.

There is a need for a diaphragm that detects pre-failure conditions across the entire surface of the diaphragm, provides for a longer useful life of the diaphragm and is easily applied to conventional pumps without any design changes of the pump.

SUMMARY OF THE INVENTION

A sensing diaphragm is provided which is particularly suitable for pump applications. The diaphragm is constructed with a sensing element provided as an overlay to cover a surface of the elastomeric body. The elastomeric diaphragm body is preferably made of neoprene. The sensing element is a laminar composite having a shape similar to that of the elastomeric body and serves as both a barrier to the elastomeric body as well as a determinant of prefailure conditions. The sensing element has at least one conductive component and at least two nonconductive components. Electrical leads connect the conductive component to a detection system. The conductive component preferably comprises densified previously expanded polytetrafluoroethylene (ePTFE) impregnated with a conductive particulate filler, such as carbon, for example. Likewise, the nonconductive components preferably comprise densified previously expanded polytetrafluoroethylene.

DETAILED DESCRIPTION OF THE INVENTION

As used herein, the term "diaphragm" means a flexible barrier that divides two fluid containing chambers or compartments. Typically, such barriers are useful with diaphragm pumps, however these diaphragms may also be employed as a barrier layer between two compartments in any application where a fluid exists in one compartment and would cause deleterious effects if present in the other compartment.

The inventive pre-failure sensing diaphragm is capable of detecting wear and small cracks in this sensing component prior to effects on the elastomeric body. In addition, the sensing component serves as a barrier layer to the elastomeric body. By determining potential failure before the integrity of the barrier is substantially compromised, the user is able to perform repairs and service the pump on a scheduled basis, rather than under emergency circumstances. Also, because pre-failure conditions exist, any hazardous fluids may be flushed from the system prior to such maintenance, thus reducing human exposure to these materials. In addition, because the sensing element substantially covers the surface of the elastomeric body, potential areas of defects and cracks can be detected independent of size or location. The inventive diaphragm is also relatively easy to manufacture.

Figure 1:
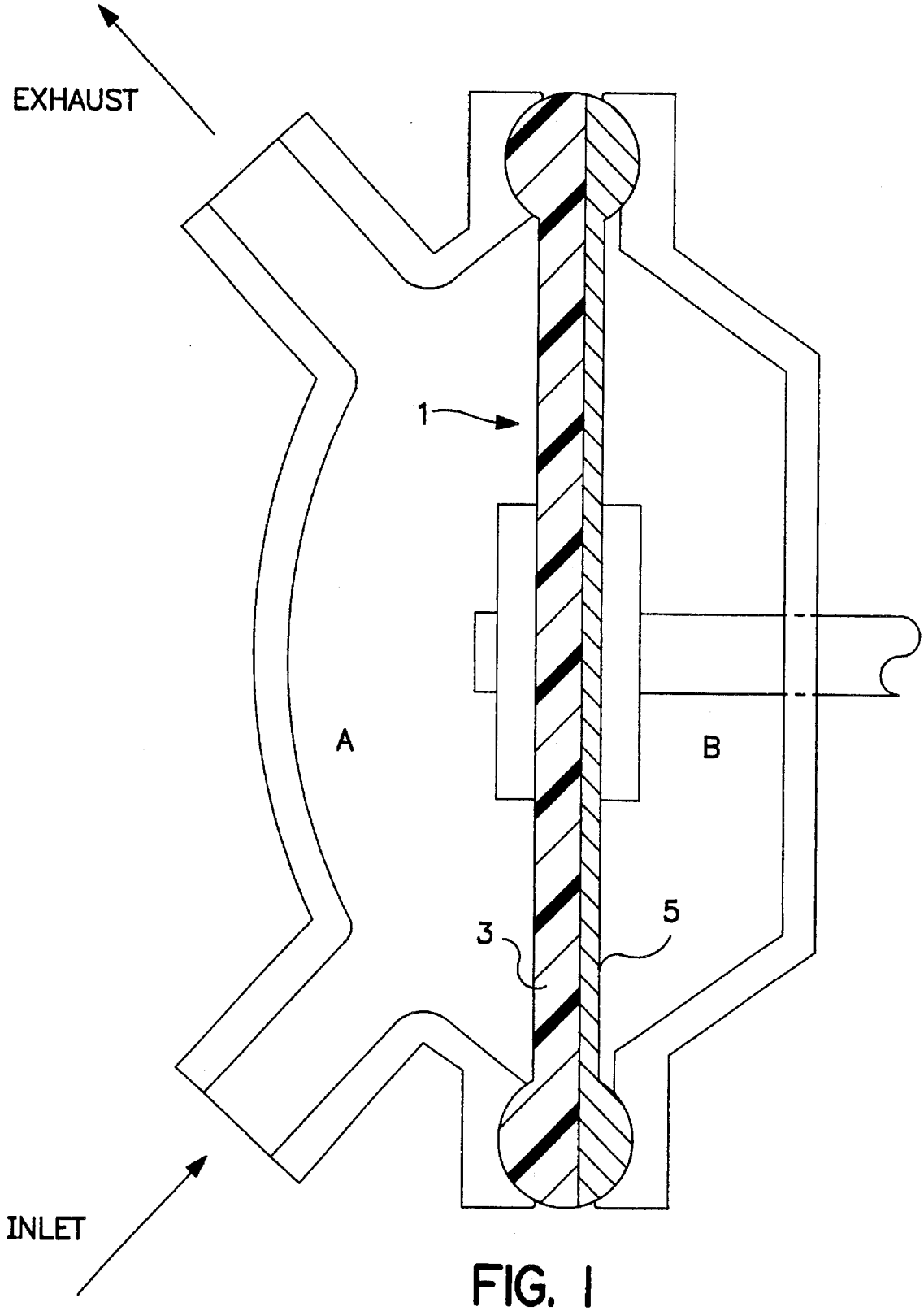
FIG. 1 (Prior Art)
FIG. 1 is a schematic cross-sectional view of a conventional pump diaphragm housed within a pump chamber.

The invention is best understood by reference to the accompanying figures. FIG. 1 shows schematic cross-section of a conventional pump chamber, with the fluid inlet and exhaust as well as the separation of the fluid chamber A from the air chamber B by a conventional diaphragm 1. The diaphragm may include a laminated structure wherein one side 3 is a sheet of a chemically inert material, such as polytetrafluoroethylene (PTFE), and the other side is an elastomeric or other rubber body 5.

Figure 2:
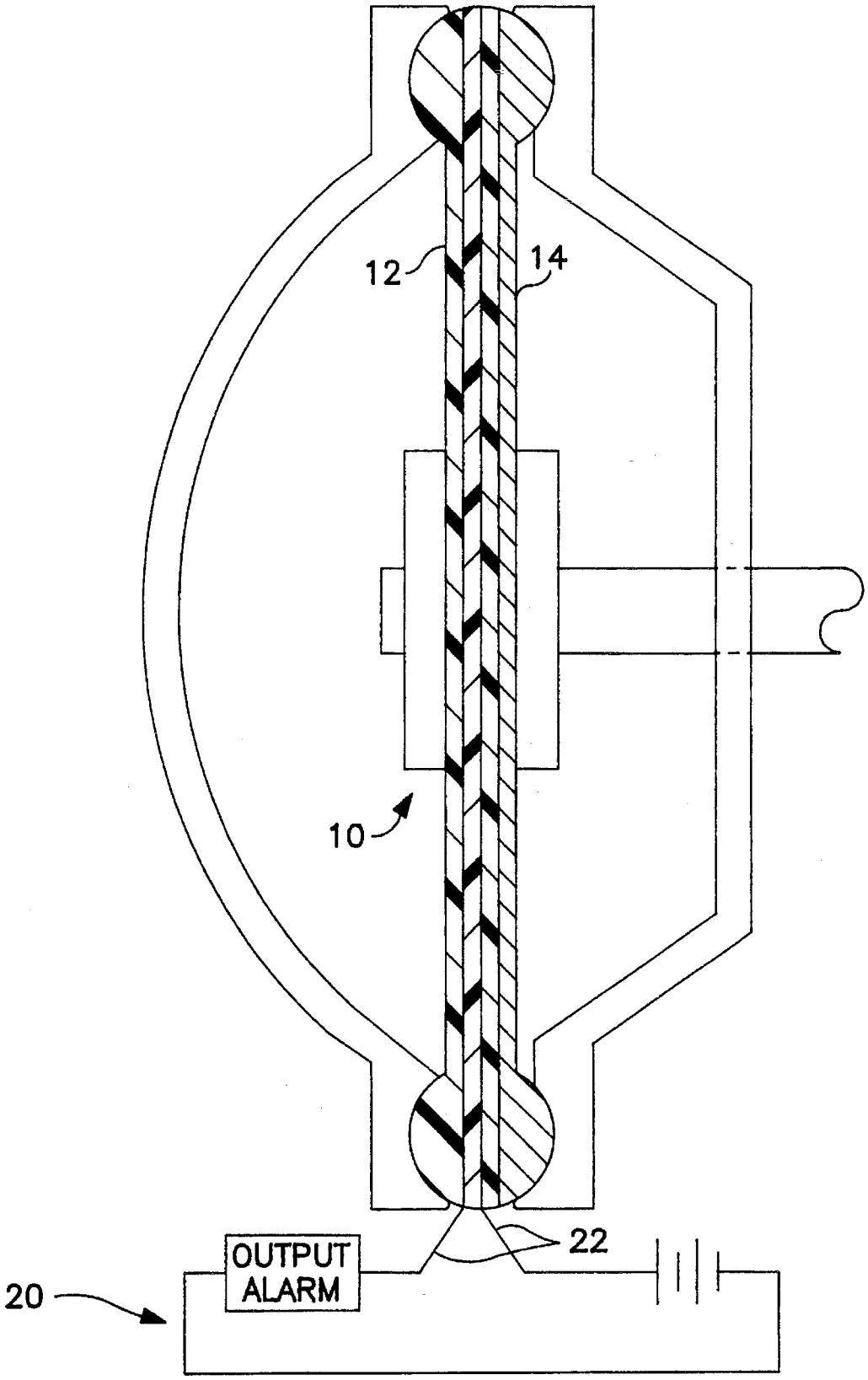
FIG. 2 is a schematic cross-sectional view of the prefailure sensing diaphragm housed within a pump chamber.

FIG. 2 is a schematic cross-sectional view of the inventive pre-failure sensing diaphragm within a pump chamber wherein the diaphragm 10 is provided with a sensing element 12 that is connected to a voltage and sensing/alarm circuit 20 via electrical leads 22. The diaphragm 10 also comprises an elastomeric body 14 having a surface over which the sensing element 12 is laid. The sensing element 12 of the diaphragm also serves as a barrier to the elastomeric body 14, and may be constructed so as to have several different configurations.

Figure 3:
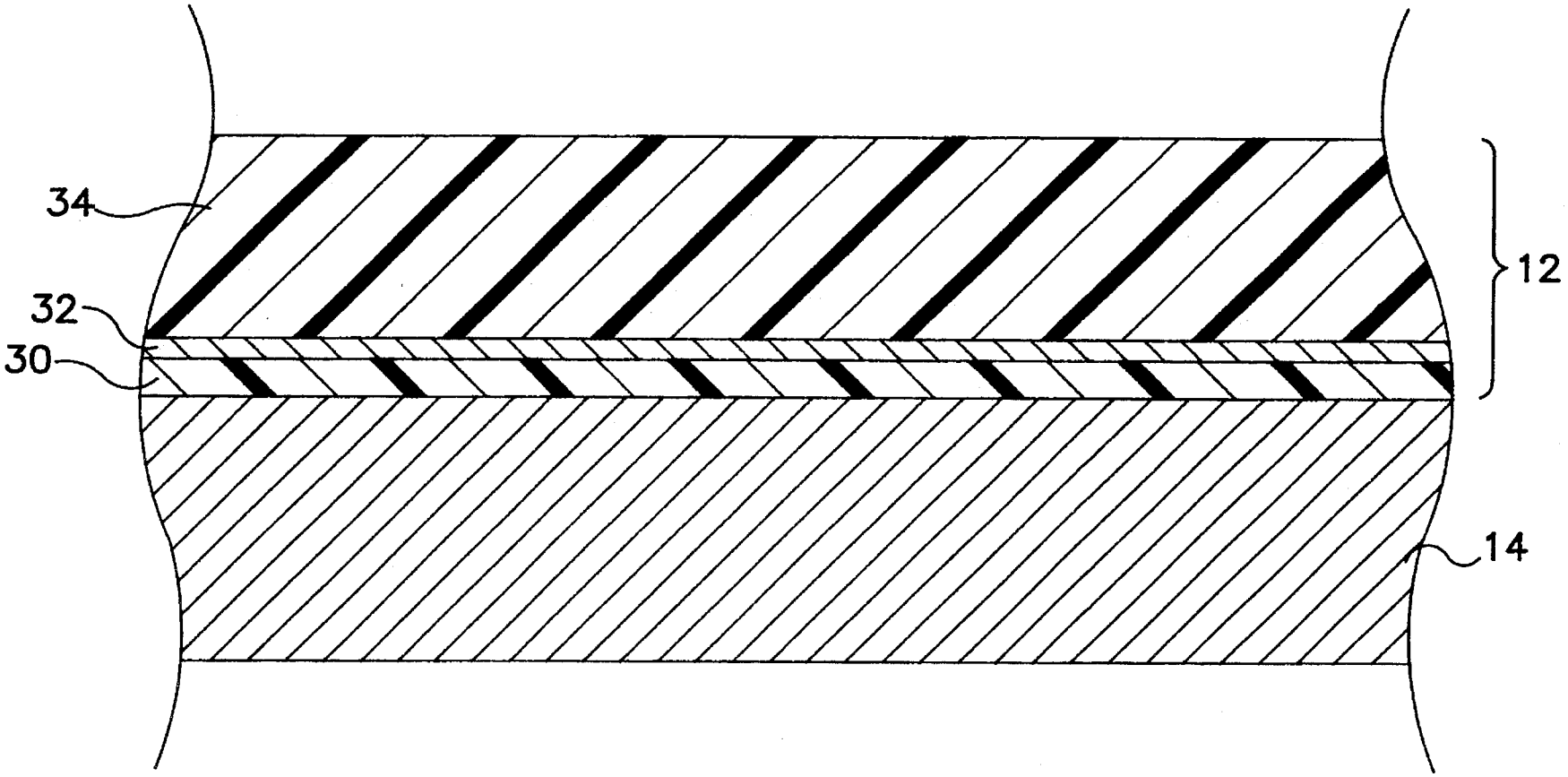
FIGS. 3–6 are exploded cross-sectional views of the different configurations suitable as the sensing component used with the pre-failure sensing diaphragm.

FIG. 3 shows the most basic embodiment of the sensing element 12. More specifically, FIG. 3 shows an exploded cross-sectional view of the layers comprising the laminate that serves as the sensing element 12. Here, a three layer laminate includes a first layer 30 of an inert nonconductive material. A preferred nonconductive material may include polytetrafluoroethylene (PTFE), and more preferably includes densified previously expanded polytetrafluoroethylene (ePTFE). An intermediate layer 32 of a conductive pliable material is superimposed over the first layer. Materials suitable for this conductive pliable layer include expanded PTFE impregnated with a conductive carbon. An outer face layer 34, of the same material as the first inert layer 30, is provided as a third layer which is superimposed over first inert layer 30 and the intermediate layer 32. Also shown in FIG. 3 is the elastomeric body 14 of the diaphragm.

Figure 4:
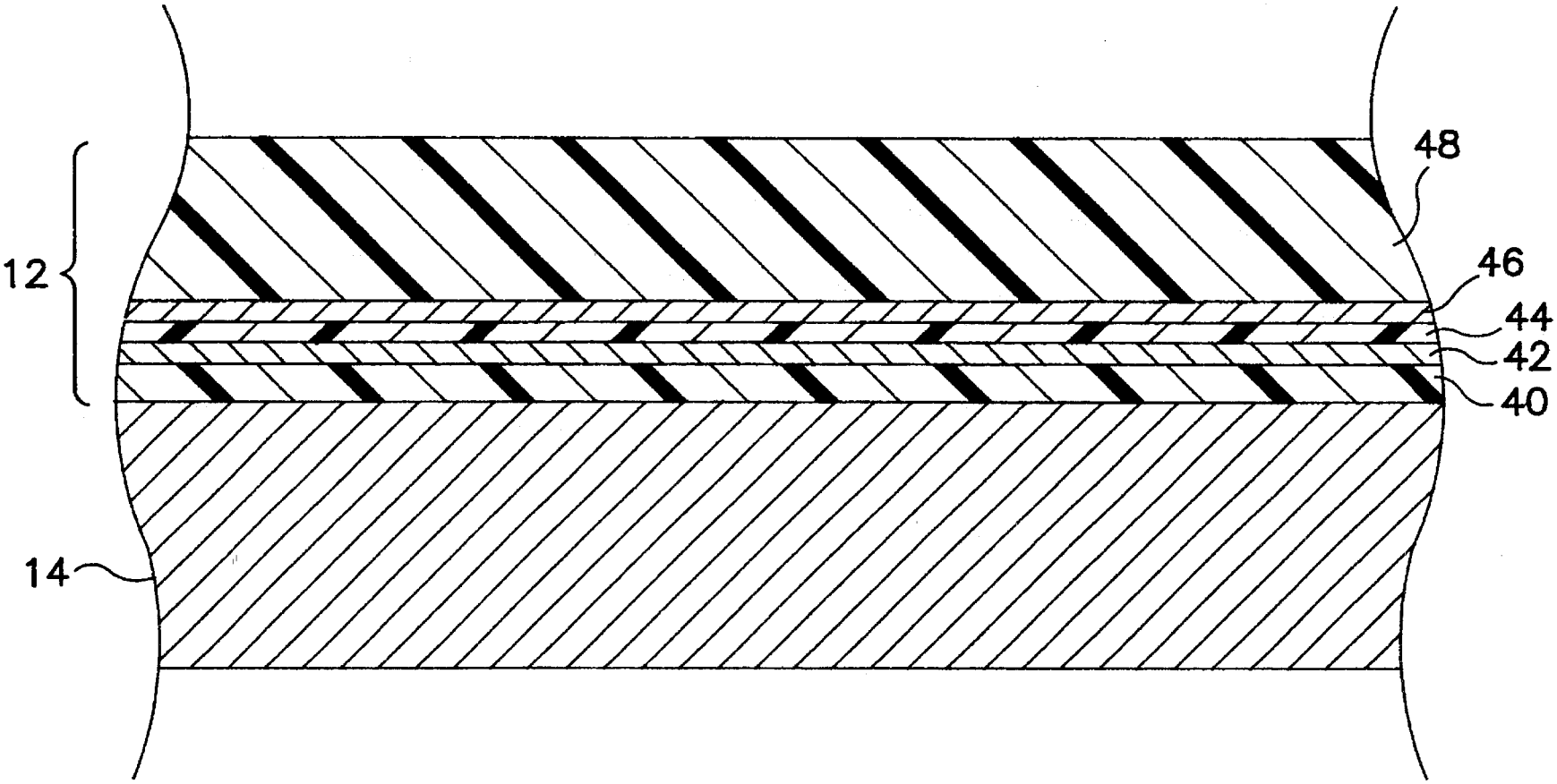

FIG. 4 shows a preferred embodiment of the invention, again in an exploded cross-sectional view. Here the material of the sensing element 12 is a multi-layer laminate including a first layer 40 of an inert nonconductive material, a first conductive layer 42, a second inert nonconductive layer 44, a second conductive layer 46, and a final outer face layer 48 of an inert nonconductive material. The positioning of an inert nonconductive layer 44 between the two conductive layers 42 and 46 ensures that the sensing circuit is open while the sensing element is operational and free of cracks and other discontinuities. This embodiment requires that the first layer 40 of inert nonconductive material be disposed adjacent to the elastomeric body 14. The layer 40 thus serves as the final layer of protection to the elastomeric body 14 even after a discontinuity or crack is detected in the outer and conductive layers (42–48). Thus, the sensing element 12 detects a pre-failure situation as layer 40 remains intact and protects the elastomeric body 14 from contamination of corrosive fluids prior to any leakage. The conductive sensing layers 42 and 46 may be located at any position throughout the element 12 depending on the application. FIG. 4 shows the conductive layers 42 and 46 at a position relatively close to the elastomeric body 14 so that the user is alerted in sufficient time to take necessary action, but not so soon that the diaphragm life is significantly reduced.

Also, and as likewise shown in FIG. 2, the two conductive layers 42 and 46 are parallel to one another and each layer is independently connected to a sensing circuit via electrical leads.

Figure 5:
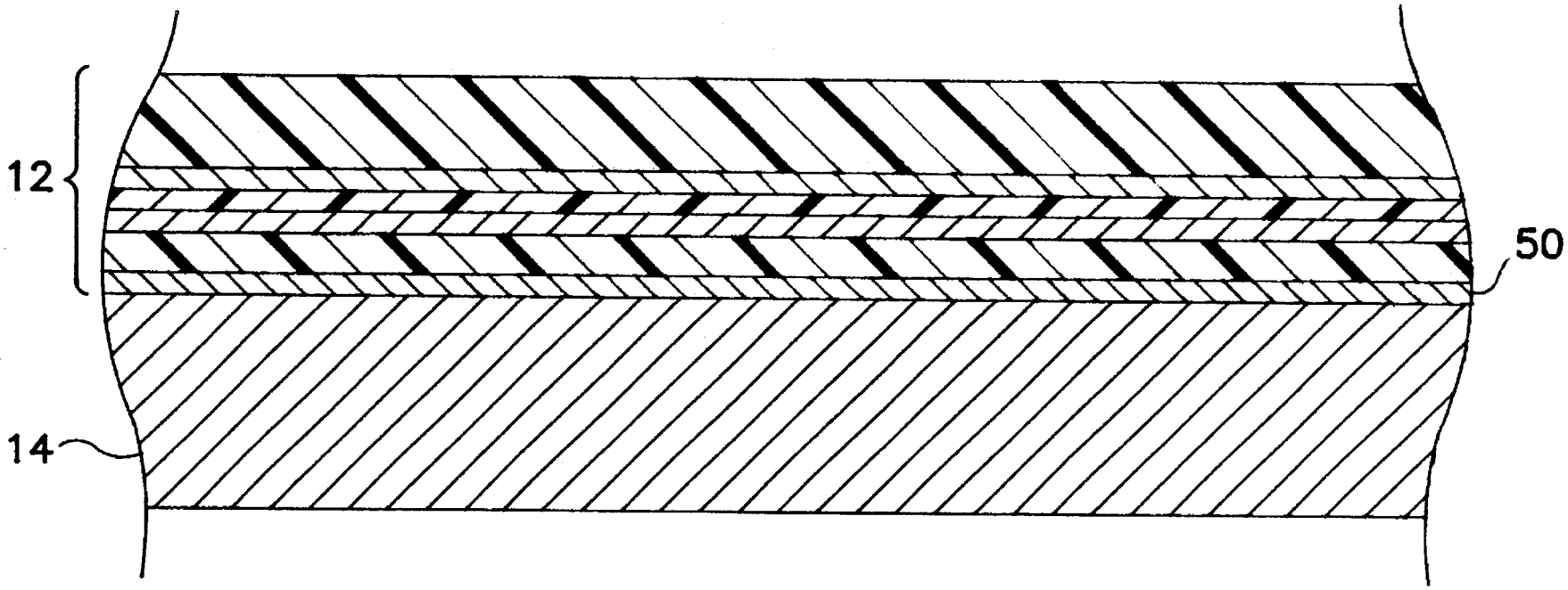

FIG. 5 shows a sensing element 12 further provided with an additional flexible conductive layer 50 that is positioned between first layer of nonconductive material 40 and the elastomeric body 14. This additional flexible conductive layer 50 covers the face of the elastomeric body 14 and is also attached by electrical leads to an alarm system. This additional layer 50 serves as a second alarm system that detects actual contamination of the elastomeric body 14.

Figure 6:
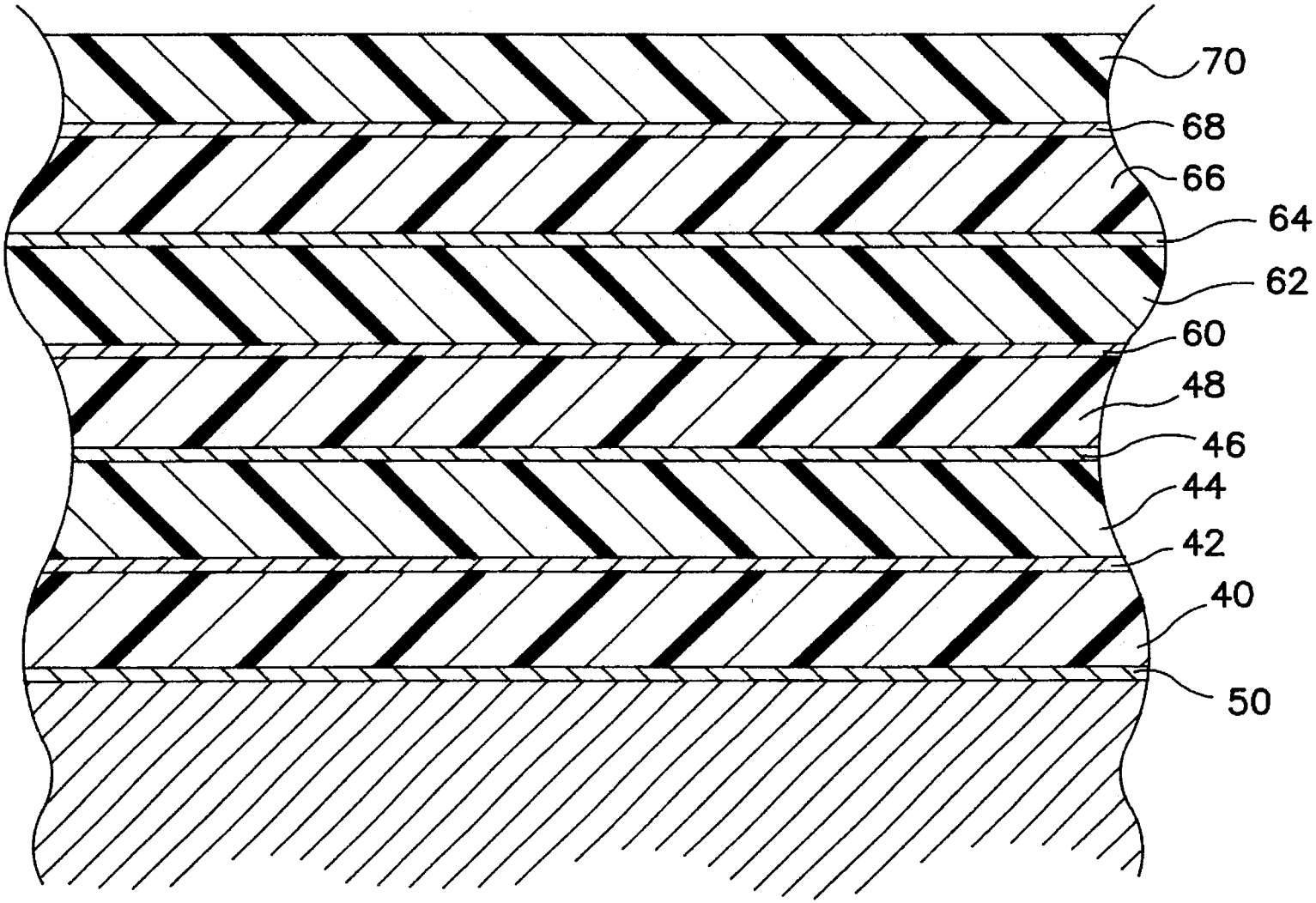

FIG. 6 shows a sensing element 12 having multiple parallel conductive layers (60, 64, 68) wherein each conductive layer is adjacent to a flexible nonconductive layer (62, 66, 70). These alternate conductive layers may be connected to various circuits to detect progressive breakdown of a diaphragm as cracks propagate through the layers and the contaminating liquid permeates these layers until it reaches the elastomeric body 14, at which time the diaphragm will ultimately fail. Such an embodiment is a useful research tool to enable measurement of rate of degradation at each stage. Any number of alternating parallel conductive and nonconductive layers may be employed depending on material dimensions and desired functionality.

Figure 7:
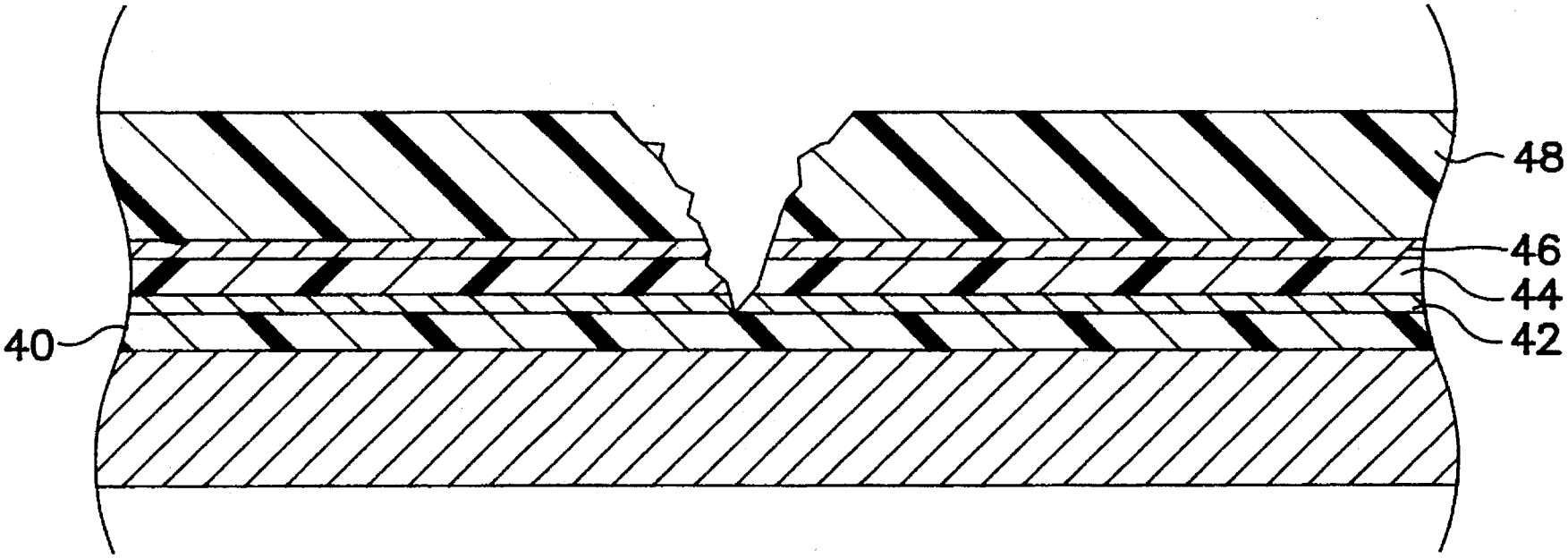
FIG. 7 is an exploded schematic view of a failure situation capable of being detected by the inventive pump.

FIG. 7 shows an exploded schematic representation of a crack or discontinuity in the sensing element 12 that ultimately leads to failure of the diaphragm. Reference may also be made to FIG. 2. Here a crack or discontinuity will appear in the outermost layer 48 of the sensing element and propagate through the conductive layer 46 which is connected to a sensing source and proceed through to the inner conductive layer 42 which is connected to voltage source. As a crack or discontinuity appears and grows, an entryway for fluid is also created. Thus, contaminating fluid proceeds past the outer conductive layer 46 and ultimately contacts the inner conductive layer 42. The fluid at this point will conduct current from the inner conductive layer 42 to the outer conductive layer 46 thereby closing the sensing circuit and triggering an alarm. As can be seen, by providing an innermost nonconductive insulating layer 40 adjacent the elastomeric body 14, a prefailure condition is detected so that the user has ample time to remedy the situation prior to propagation of a discontinuity through the innermost layer 40.

For any of the above described embodiments, the resilient elastomeric layer can be a thermosetting elastomer, thermoplastic elastomer, or a thermoplastic polymer having a flexural elastic modular (ASTM D790-84A) of less than 1,400 MPa.

The thermosetting elastomer can be a fluoroelastomer including perfluoroelastomers, fluoroelastomer containing silicone moieties, nitrile elastomer, acrylic elastomer, olefin diene elastomer, chlorosulfonated polyethylene elastomer, polychloroprene elastomer, butyl and halogenated butyl elastomer, styrene-butadiene elastomer, polydiene elastomer, or silicone elastomer. Preferred elastomers include Neoprene, a chlorobutadiene and Viton®, a fluoroelastomer commercially available from E. I. DuPont de Nemours, Inc. of Wilmington, Del.

The thermoplastic elastomer can be a polyetherester elastomer, polyurethane elastomer, styrene polyolefin block copolymer elastomer, polyamide elastomer, or ethylene copolymer elastomer.

The thermoplastic having a flexural elastic modulus (ASTM D790-84A) less than 1,400 MPa, can be selected from fluorinated thermoplastics such as copolymers of tetrafluoroethylene, copolymers of vinylidene fluoride, copolymers of chlorotrifluoroethylene, polyolefins, or plasticized polyvinyl chlorides.

The sensing element of any of the embodiments described above have identical components, but vary in the number and location of conductive and nonconductive layers as can be seen in FIGS. 3–6. The inert nonconductive chemical resistant layers serve as a barrier against corrosive chemicals, or serve to maintain the purity of the fluid within the chamber to which the diaphragm is applied. The nonconductive layers are preferably PTFE, and are most preferably expanded PTFE which is subsequently densified, as described in U.S. Pat. No. 5,374,473 herein incorporated by reference. (An example of full density PTFE is skived PTFE). As described above, the PTFE layer provides an inert protective surface that is resistant to degradation by corrosive chemicals, which thereby increases the durability and chemical resistance of any underlying elastomeric layer.

The conductive layer(s) of the sensing element are preferably made of a chemically inert material, such as expanded porous PTFE that has been filled or impregnated with conductive carbon and subsequently densified. This filled or impregnated PTFE may be formed by blending a fine powder PTFE resin with mineral spirit and then adding a conductive particulate filler to obtain a compound of fine powder PTFE resin and conductive particulate filler as described in U.S. Pat. No. 4,985,296 herein incorporated by reference. The amount of conductive particulate used as a filler should be greater than 1% and less than 90% by weight.

As described in U.S. Pat. No. 4,985,296, compression and densification increases contact between individual conductive particulate filler particles thereby increasing conductivity of the ePTFE matrix in continuous film form. To increase the strength of the thin ePTFE matrix in continuous film form, multiple layers of the extrudate may be stacked longitudinally and calendared upon one another to form an integral article. The article is subsequently dried, expanded, and densified to produce a thin ePTFE matrix of greater strength when compared to an analogous thin ePTFE matrix produced from a single layer. The thin ePTFE matrix may then be heat treated as taught in U.S. Pat. No. 3,953,566, also herein incorporated by reference.

The sensing element 12 may be constructed as follows. A first layer of inert nonconductive material is obtained. This layer of inert nonconductive material may in fact be one or more plies of film, such as ePTFE film that are stacked on top of each other. Next, a conductive layer such as carbon filled ePTFE is superimposed on the first layer. Depending on the particular application, additional layers of inert nonconductive material followed by a second conductive layer are plied together to form a stack and build up the sensing element. If a conductive layer is desired as a bottommost layer to indicate complete failure of the sensing element as a barrier, such as that shown in FIG. 5, an additional conductive layer such as carbon filled ePTFE may be placed underneath the stack. For any of the constructions, care must be taken to ensure that the conductive layers do not contact each other.

In addition, an inert film may also be inserted between the conductive and nonconductive layers to prevent a portion of these conductive layers from bonding to the nonconductive layers so that electrical connections can be made at a later time. Alternatively, electrical lead wires may be inserted directly into the stack of plies or layers during construction.

If the stack of nonconductive and conductive layers comprises layers of expanded PTFE, the stack of multilayers may then be compressed and sintered so that the final density of the composite of stacked layers is at least 2.10 g/cc. The post compression thickness of the sensing element is controlled by varying the total number of layers or plies used.

The sensing element 12 may be used alone or may be attached to a sheet of uncured elastomeric that is to be formed into an elastomeric body 14. When the sensing element 12 has a bottom layer of PTFE to be attached to the elastomeric sheet, its contacting surface may be etched with a material such as alkali naphthanate so as to increase the surface energy of the PTFE thereby increasing its adhesion to the elastomer. To further facilitate bonding of the PTFE to the elastomeric body, an adhesive may also be applied to the etched surface, such as Chemlok 250 available from Lord Corp., of Erie, Pa.

The sensing element 12 and sheet of uncured elastomer 14 are then cut to a shape and size which enables it to be molded without interfering with the mold closure. Typically this requires that they be cut in the shape of circles. The elastomer and sensing element are then assembled into a pre-form and molded to a desired shape. If a thermoplastic elastomer is used instead of an uncured elastomer such as neoprene or Viton®, an injection molding step may take the place of the compression molding step.

EXAMPLE

A sensing element 12 and elastomeric body 14 were used to construct a diaphragm for a pump application as shown in FIG. 2. The sensing element was first constructed according to the following procedures.

Three plies of expanded polytetrafluoroethylene (ePTFE) membrane, each 61 cm×92 cm were plied together to form an integral layer. One layer of conductive carbon filled ePTFE (5% by weight) of the same dimensions was placed on top of the ePTFE layer. As a means to prevent an electrical short between the layers by the center shaft of the pump upon installation, a hole having a diameter of 5 cm was cut in this conductive layer at a position approximately 30 cm from a long edge and at least 15 cm from a shorter edge. Subsequently, three plies of ePTFE membrane (forming an integral layer), a second layer of conductive carbon filled ePTFE (5% by weight) and four plies of ePTFE were placed on top of the first conductive layer to form a stack. A strip (15 cm wide) of Kapton® polyimide film, available from E.I. DuPont de Nemours Co., of Wilmington, Del. was placed on top of each conductive carbon filled ePTFE layer along the same long edge from which the measurement for the hole in the first conductive layer was taken. The placement of this polyimide strip prevents one side of each of the conductive carbon filled ePTFE layers from bonding to the ePTFE layers in this region.

The composite assembly was then placed between two stainless steel plates of the same dimensions. The material and plates were then packaged in a flexible container made of Kapton® polyimide film. A vacuum of 755 mm Hg was drawn inside the package. The package was then loaded into an autoclave (available from Vacuum Press International) and subjected to a pressure of 1.7 MPa while being heated to 370° C. in accordance to the teachings of U.S. Pat. No. 5,374,473.

A disc was cut from the composite assembly with a circular cutting die (29 cm in diameter) to form a sensing element. To cut this disc, the die was positioned to be concentric with the hole cut from one of the conductive layers. Due to the translucent nature of the compressed material, this point was easily identified. The composite sensing element was then etched on one surface with TETRA-ETCH® solution, (an alkali naphthanate solution available from W. L. Gore & Associates, Inc. of Elkton, Md.) to facilitate its bonding to the elastomer which was subsequently applied. An adhesive, Chemlok 250 available from Lord Corporation of Erie, Pa., in a 40% by volume toluene solution was applied by brush to the etched surface and allowed to dry at room temperature for about 30 minutes.

A layer of nylon reinforced neoprene having a thickness of 3.8 mm was cut with a die (having a diameter of 23.5 cm) and subsequently placed concentric to the sensing element such that the etched and adhesive applied surface was facing the neoprene. The resulting pre-form weight was 362 grams. This pre-form was then placed in a diaphragm mold. The mold was compressed in a platen press at a pressure of 1.72 MPa and a temperature of 186° C. for 6 minutes. The composite diaphragm was then removed and allowed to cool. Excess material on the outside of the compressed area was trimmed except for a 1.25 cm wide strip of material in the region of the PTFE in which the Kapton® strip was located to prevent bonding of the conductive to the nonconductive layers.

Two 20 gauge copper wires insulated with polyvinyl chloride were each cut to a length of 25.4 cm. Approximately 2.5 cm of insulation was stripped from one end of each of the wires. These ends were then bent into a hook shape to enhance mechanical retention when installed within the layers of the sensing element. Two strips of fluorinated ethylene propylene (FEP) film (each 4 cm by 7.5 cm having thicknesses of 0.125 cm) were cut. The hooked end of one of the copper wires was placed on top of the exposed part of the conductive layer (i.e. voltage layer) closest to the etched inert nonconductive layer. One of the FEP strips was then placed over the hooked end of the wire and both strip and wire were then adhered in place such the FEP strip did not interfere with further processing. The second electrical wire and strip of FEP were similarly secured on top of the second conductive layer (i.e. sensing layer). This assembly was then heat sealed together with an Impulse Heat Sealer commercially available from Vertrod Corporation of Brooklyn, N.Y. Two additional FEP strips (each having a width of 5 cm, length of 7.5 cm and thickness of 0.125 cm) were placed on the top and bottom of the heat sealed assembly and also heat sealed to prevent electrical shorts in this region.

The periphery of the entire composite diaphragm was then sealed with butyl rubber by first etching the outside edge and then applying the butyl rubber caulk with a spatula. The caulking material was allowed to cure over 24 hours. The composite diaphragm was first tested for electrical shorts by connecting it to a Mega-Ohm meter and measuring the resistance. The meter dial indicated on the 100 MΩ scale, indicating that sufficient electrical insulation between the conductive layers was present.

The composite diaphragm was installed in a pump (Wilden M-4 air operated diaphragm pump commercially available from Wilden Pump and Engineering of Colton, Calif.) and oriented so that the electrical leads protruded from one of the gaps in the sealing rings. The pump was then operated under harsh conditions (690 kPa inlet air pressure, 345 kPa of head pressure) to expedite diaphragm failure. The Mega-Ohm meter reading dropped initially to 1.5 MΩ upon initiation of diaphragm flexing due to the electric current generated by the motion of the diaphragm. The meter was then monitored periodically so that the pump could be shut down when the resistance dropped to ensure that the pumping fluid (water) was completing the circuit. The target resistance threshold value was 500 kohms. Approximately 56 hours after initiation of the test, it was observed that the resistance value was 200 kohms. The pump was shut down and the diaphragm was removed and dried in an oven.

Upon inspection, it was observed that the composite diaphragm had worn through to at least one of the conductive layers, but was still protected by the inert nonconductive layer adjacent the neoprene so that the neoprene was unaffected by the harsh treatment. To confirm that the resistance drop was in fact due to the expected wearing through the sensing element, the composite diaphragm was reconnected to the meter and resistance was measured to be 350 MΩ. A dampened sponge was then brought into contact with each of the suspected abrasion regions of the diaphragm and the resistance was again tested. Upon contact with these regions, the resistance dropped to 1 MΩ indicating that fluid had completed the circuit between conductive layers of the sensing element.

Other embodiments of the invention will be apparent to those skilled in the art from a consideration of this specification or practice of the invention disclosed herein. It is intended that the specification and example be considered as exemplary only, with the true scope and spirit of the invention being indicated by the following claims.

We claim:

1. A flexible sensing element for detecting a deteriorating condition of a barrier comprising:

(a) first and second nonconductive layers having identical planar areas, and top and bottom surfaces;

(b) a first conductive layer having a planar area of similar dimension to the nonconductive layers and top and bottom surfaces wherein the conductive layer is located between the first and second nonconductive layers, wherein the first conductive layer is comprised of expanded polytetrafluoroethylene impregnated with a conductive particulate filler;

(c) electrical leads connected to the conductive layer; and (d) a detection system to which the leads are also connected.

2. The flexible sensing element of claim 1 further comprising a second conductive layer attached to a nonconductive layer, both layers having planar areas similar to the other nonconductive and conductive layers, wherein said second conductive layer is attached to a nonconductive layer on the surface opposite the surface attached to the first conductive layer so that the second conductive layer is also sandwiched between two nonconductive layers and an electrical lead is connected to said second conductive layer and detection system.

3. The flexible sensing element of claim 2 further comprising a third conductive layer having a planar area similar to the other layers, wherein said third conductive layer is attached to only one nonconductive layer and has an exposed surface.

4. The flexible sensing element of claim 1 wherein the first and second nonconductive layers are comprised of densified expanded polytetrafluoroethylene.

5. A flexible diaphragm comprising:

(a) a resilient elastomeric body;

(b) a flexible sensing element and barrier having at least two nonconductive layers and at least one conductive layer sandwiched between the two nonconductive layers and means for attaching the flexible sensing element to the resilient elastomeric body;

(c) electrical leads connected to the conductive layer of the sensing element; and (d) a detection system to which the electrical leads are also connected; and wherein at least one conductive layer of the flexible sensing element is comprised of expanded polytetrafluoroethylene impregnated with a conductive particulate filler and the nonconductive layers of the flexible sensing element are comprised of a layer of polytetrafluoroethylene.

6. The diaphragm of claim 5 wherein the conductive particulate filler is conductive carbon.

7. The diaphragm of claim 5, wherein the diaphragm is designed for use in a diaphragm pump.

8. The diaphragm of claim 7 wherein the sensing element comprises an assembly of superimposed layers including a nonconductive component, a first conductive component, a second nonconductive component, a second conductive component, and a third nonconductive component.

9. The diaphragm of claim 8 wherein the sensing element further comprises a third conductive component that is located adjacent the resilient elastomeric body.

10. The diaphragm of claim 7 wherein the sensing element comprises a plurality of conductive and nonconductive components that are layered on top of each other such that each conductive component is located between two nonconductive components.

11. The diaphragm of claim 5, wherein the elastomeric body is Neoprene.

12. The diaphragm of claim 5, wherein the elastomeric body is selected from the group consisting of thermosetting elastomers, thermoplastic elastomers, and thermoplastic polymers having a flexural elastic modulus of less than 1,400 MPa.

13. The diaphragm of claim 12 wherein the thermosetting elastomers are selected from the group consisting of perfluoroelastomers, fluoroelastomer containing silicone moieties, nitrile elastomer, acrylic elastomer, olefin diene elastomer, chlorosulfonated polyethylene elastomers, polychloroprene elastomer, butyl and halogenated butyl elastomer, styrene butadiene elastomer, polydiene elastomer, and silicone elastomer.

14. The diaphragm of claim 12 wherein the thermoplastic elastomer is selected from the group consisting of copolyether elastomer, polyurethane elastomer, styrene polyolefin block copolymer elastomer, polyamide elastomer, and ethylene copolymer elastomer.

15. The diaphragm of claim 5, wherein the polytetrafluoroethylene of the nonconductive layers is densified expanded polytetrafluoroethylene.

16. A flexible sensing element for detecting a deteriorating condition of a barrier comprising:

(a) first and second nonconductive layers having identical planar areas, and top and bottom surfaces;

(b) a first conductive layer having a planar area of similar dimension to the nonconductive layers and top and bottom surfaces, wherein the conductive layer is located between the first and second nonconductive layers, wherein the first conductive layer is comprised at least in part of a porous fluoropolymer material impregnated with a conductive particulate filler;

(c) electrical leads connected to the conductive layer; and (d) a detection system to which the leads are also connected.

17. The flexible sensing element of claim 16 further comprising a second conductive layer attached to a nonconductive layer, both layers having planar areas similar to the other nonconductive and conductive layers, wherein said second conductive layer is attached to a nonconductive layer on the surface opposite the surface attached to the first conductive layer so that the second conductive layer is also sandwiched between two nonconductive layers and an electrical lead is connected to said second conductive layer and detection system.

18. The flexible sensing element of claim 17 further comprising a third conductive layer having a planar area similar to the other layers, wherein said third conductive layer is attached to only one nonconductive layer and has an exposed surface.

19. The flexible sensing element of claim 16 wherein the first and second nonconductive layers are comprised of densified expanded polytetrafluoroethylene.

* * * * *